United States Patent [19]

Ricci

[11] Patent Number: 5,064,443

[45] Date of Patent: Nov. 12, 1991

[54] PROCESS FOR DYEING TEXTILES IN A NON-UNIFORM FASHION AND RESULTING TEXTILE PRODUCTS

[75] Inventor: Francesco Ricci, Sanitarcangelo di Romagna, Italy

[73] Assignee: Golden Trade S.R.L., Italy

[21] Appl. No.: 151,479

[22] Filed: Feb. 2, 1988

[30] Foreign Application Priority Data

Jul. 6, 1987 [IT] Italy ..... 21185 A/87

[51] Int. Cl.[5] ..... D06P 5/00

[52] U.S. Cl. ..... 8/479; 8/543

[58] Field of Search ..... 8/499, 479, 447, 552, 8/557, 478, 498, 483, 485, 632

[56] References Cited

U.S. PATENT DOCUMENTS

| | | | |
|---|---|---|---|
| 223,019 | 12/1879 | Vaughan | 8/632 |
| 242,081 | 5/1881 | Vaughan | 8/498 |
| 1,253050 | 1/1918 | Kitsee | 8/483 |
| 1,275,771 | 8/1918 | Scott | 8/483 |
| 1,714,941 | 5/1929 | Boldireff et al. | 8/498 |
| 1,858,859 | 5/1932 | Katz | 8/483 |
| 1,921,635 | 8/1933 | Phair | 8/498 |
| 2,199,093 | 4/1940 | Wolfenden | 68/20 |
| 2,629,647 | 2/1953 | Pitt | 8/483 |
| 3,415,185 | 12/1968 | Paterson et al. | 101/211 |
| 3,432,446 | 3/1969 | Coppeta | 106/22 |
| 3,589,854 | 6/1971 | Cobb et al. | 8/483 |
| 3,726,640 | 4/1973 | Takriti et al. | 8/483 |
| 3,947,246 | 3/1976 | Eibl | 8/478 |
| 3,994,683 | 11/1976 | Zimmer et al. | 8/498 |
| 4,397,650 | 8/1983 | Gregorian et al. | 8/477 |

OTHER PUBLICATIONS

Legler brochure.

A. J. Hall, "The Standard Handbook of Textiles;" p. 241, Wiley (1975).

*Primary Examiner*—Prince E. Willis

*Assistant Examiner*—John F. McNally

*Attorney, Agent, or Firm*—Bryan, Cave, McPheeters & McRoberts

[57] ABSTRACT

A process for dyeing a textile in a non-uniform fashion is described which involves disposing rigid, permeable and porous granules impregnated with a solution or dispersion of one or more dyestuffs together with a textile product in a chamber and randomly contacting the textile with the granules. After removing the granules, the textile may be heated or steamed to fix the dyestuff, and washed to remove excess dyestuff.

19 Claims, 3 Drawing Sheets

PROCESS FOR DYEING TEXTILES IN A NON-UNIFORM FASHION AND RESULTING TEXTILE PRODUCTS

BACKGROUND OF THE INVENTION

1. Field of the Invention

The present invention relates to a process for dyeing textiles in a non-uniform fashion, and to the so-obtained dyed textiles.

The term "textiles" as used in the present disclosure and in the appended claims refers to yarns or threads in the form of skeins or wound on a planar structure, plain or textured fabrics, cloths, e.g., cotton cloth generally known as "denim," and ready-to-wear apparel such as trousers, jeans, jackets, sports jackets, shirts, blouses, vests, skirts, shorts, swimsuits, etc.

It is known that dyeing of textiles may be carried out according to a number of different processes, the particular process selected generally being related to the material to be dyed.

Generally, the dyeing process involves charging a textile material to a dyeing bath, ordinarily comprising water and a dyestuff or dyestuff mixture in either dissolved or dispersed form, optionally together with dyeing auxiliaries. The bath is heated to a determined temperature for the purpose of making the dyestuff penetrate the textile and become fixed to it. The dyed product is then repeatedly washed with water to remove any excess absorbed dyestuff, and it is finally dried. If desired, the dyeing process may be followed by a chemical fastening treatment to fasten the deposited dyestuff.

In turn, the exhausted dyeing bath generally will undergo a process to recover or remove the dyestuff(s).

Although the foregoing dyeing process is the most commonly used, it suffers from several drawbacks. First of all, it requires a large amount of water, generally hot water. An average dyeing cycle requires from five to more than 100 liters of water per kg of dyed product, the water typically being heated to a temperature of approximately 80° to 130° C. Furthermore, the dyeing operation is lengthy and laborious.

These drawbacks are greatly increased when a non-uniformly dyed product is desired. In this case, the dyeing operation may involve several different dyeing cycles, each cycle with a different dyestuff, and during each cycle protecting certain areas (reserves) which are not to be dyed by that specific dyestuff.

Printing of fabrics is another technique for producing particular patterns. This process requires the use of structured blocks to obtain a given pattern. Furthermore, while printing can be carried out relatively easily on fabrics, difficulties arise when ready-to-wear apparel or a flat portion of the ready-to-wear apparel is to be printed.

The dyeing processes known in the art make it possible to obtain uniform dyeings or well-defined or overlapping patterns, but do not permit the obtaining of non-uniform, discontinuous, or random, maculated dyeings.

SUMMARY OF THE INVENTION

According to the present invention a non-uniform, discontinous, or random, maculated dyeing which does not have the above-mentioned drawbacks is obtained by a process comprising the following steps:

(a) disposing a textile in a chamber together with rigid, coarse, permeable granules, the granules having been impregnated with a dyestuff;

(b) contacting the textile with the granules, the textiles and granules being in relative random movement with respect to each other, for a time sufficient to randomly dye the textile; and (c) separating the randomly dyed textile from the granules.

The randomly dyed textile may be subsequently treated to fix the dyestuff to the textile, e.g., by thermal or chemical means, and excess dyestuff may be removed by washing. In one embodiment of the invention, some of the granules are impregnated with a given dyestuff and other of the granules are impregnated with a different dyestuff, and the whole is contacted with the textile to produce a random multi-colored effect. In another embodiment, a random multi-colored effect may be obtained by successively contacting the textile with granules impregnated with different dyestuffs. The random contact between the textile and the impregnated granules is preferably carried out in a rotatable drum.

DETAILED DESCRIPTION OF THE INVENTION

Figure 1:
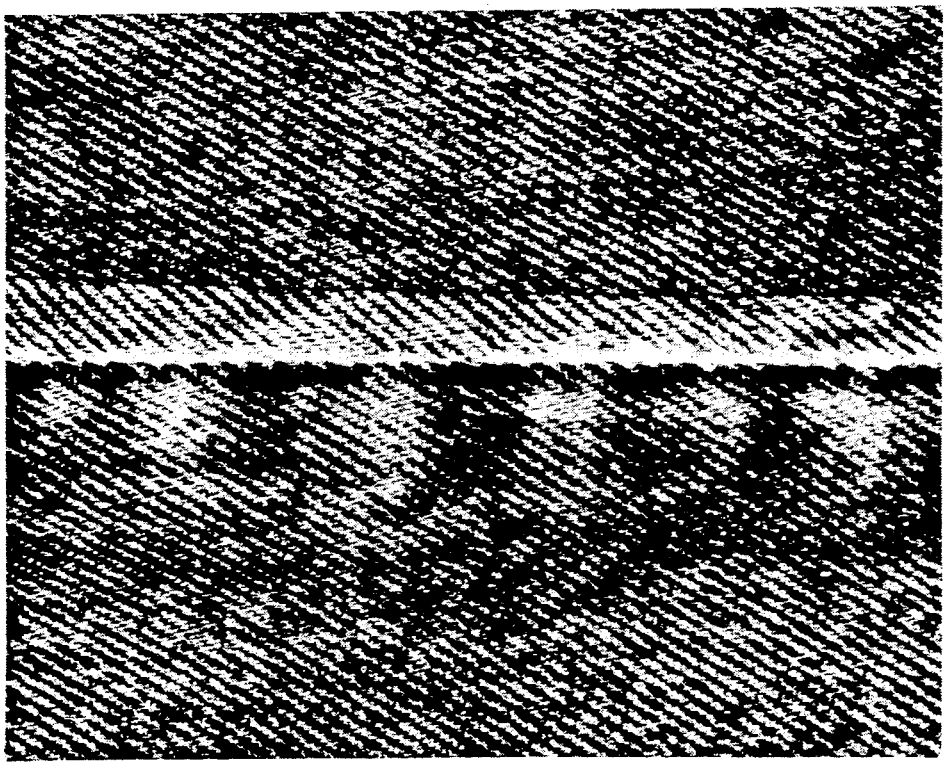
FIGS. 1–3 are photographs of textiles randomly dyed according to applicant's invention.

The rigid, permeable, granules may be impregnated with a solution or a dispersion which contains only one or a mixture of dyeing substances. The granules may be impregnated with a single solution containing a dyestuff or dyestuff mixture, or some of the granules may be impregnated with a given dyestuff solution and other of the granules may be impregnated with a different dyestuff solution, and the whole contacted with the textile to produce a random multi-colored effect. Alternatively, the textile may initially be contacted with granules impregnated with a first dyestuff or mixture of dyestuffs and then subsequently, separately the textile may be contacted with granules impregnated with a second dyestuff or mixture of dyestuffs. Additional contacts with granules impregnated by other dyestuffs may follow, depending on the desired multi-colored effect.

Any granule which is rigid, porous and endowed with high absorption properties may be used in the process of the present invention. The granule may be a natural or synthetic material, and in this latter case, it may be of organic or inorganic composition. The granules preferably have average dimensions of from 0.001 to 20 cm, preferably of from 0.1 to 5 cm, and each granule has at least one porous surface, e.g., a cellular structure with a plurality of passages leading from the inner to the outer region thereof.

Examples of porous, rigid, granular, permeable granules which may be used in the process of the present invention include pumice stone, silica gel, or granules of open cell foamed polystyrene, open pore rigid foam of polystyrene, of polyethylene, of polyvinyl chloride, of cellulose acetate, of polypropylene, of phenolformaldehyde resins, or of polyurethanes, rigid cellular rubber, or other rigid expanded polymeric substances. The sizes or dimensions of the pores may be adjusted to achieve the desired effect. These foams and methods for their preparation are well known in the art and are described, e.g., in Cellular Plastics—Recent Developments (1970), Johnson, Noyes Data Corporation. Pumice stone is a particularly preferred rigid granule.

The presence of pores or passages leading from the inside to the outside of the granules ensures a regular release of the dyestuff during the dyeing cycle. The dyestuff passes by means of the passages through the walls of the granules, and is deposited on the surface of the textile in areas where the impregnated granules contact the textile. This passage is made easier by, e.g., placing the granules and textile in a drum, and rotating the drum. The porous granules may be of any shape, e.g., a regular or irregular geometrical figure, e.g., a cylinder, sphere, polygon, etc.

The porous granules used in the process of the present invention remain substantially rigid throughout the process. Indeed, if instead there is used a rigid product in a fine powdered form, or a flexible and soft porous product, e.g., a sponge, one does not obtain the discontinuous, random, maculated dyeing effect which results from the practice of the present invention.

After the dyeing process is completed, the porous granules are preferably recovered and again impregnated with the same dyestuff for use in a subsequent dyeing treatment.

Any known dyestuff generally used for printing or for dyeing may be used in the process of the present invention. Examples of suitable dyestuffs include reactive dyestuffs, sulphur dyestuffs, cationic dyestuffs, direct dyestuffs, mordant dyestuffs, pigments, etc. These dyestuffs are dissolved or dispersed, preferably in water, optionally together with other chemical auxiliaries such as dispersing agents, emulsifiers, lubricants, etc. If desired, however, the dyestuffs may be dissolved in basic or acidic aqueous solutions or in an organic solvent.

If the dyestuff is a pigment, a bonding agent may be added to the dispersion or paste. The bonding agent is generally a dispersion or solution of a polymer such as a derivative of polyacrylic acid, polyurethane derivatives, butadiene/styrene copolymers, etc. Generally a synthetic latex is used which, because of its film-forming properties, keeps the pigment bonded to the surface of the product being dyed. The dispersion or paste may also contain a thickener.

The granules may be impregnated with the dyestuff solution or dispersion by means of any known technique. Preferably the impregnation step is carried out by spraying the dyestuff solution or dispersion onto the granules.

Desirably, a rotary drum of any type and size may be used to carry out the random dyeing of the present invention. For example, the drum of a washing machine equipped with internal beaters is conveniently used. The rotational speed of the drum is preferably adjusted so that the impregnated granules continuously fall down on the textile due to gravity. The rotational speed may vary. For example, speeds of from 1 to 50 rpm may be used. It is of course possible to employ chambers other than a rotary drum in the process of the present invention, so long as the chamber provides sufficient random contact between the impregnated granules and the textile, i.e., so that the textile and the granules are in relative movement with respect to one another.

The residence time in the chamber of the textile and the porous granules impregnated with the dyestuff solution or dispersion will vary, depending on the particular desired effect. Generally, the residence time is from about 1 to 10 minutes when a very discontinuous or largely random, maculated effect is desired, and from 10 to 60 minutes when a mildly random, maculated effect, a "marble" effect, or a "fog-type" effect is desired.

The weight ratio of the porous, impregnated granules to the textile may vary over a wide range, generally from about 1:1 to 100:1, and preferably from about 2:1 to 50:1.

The granules and textile are contacted under substantially dry conditions. Thus, the granules and textile are generally contacted in the absence of added liquid. Thereafter, the granules are removed. The dyed textile may then be heated or steamed to fix the dyestuff to the textile. Such a thermal treatment may be carried out inside the drum of the washing machine, provided the washing machine has heating means, or it may be carried out elsewhere. As is well known, the thermal treatment conditions may vary, e.g., higher treatment temperatures permit shorter treatment times and vice versa. The thermal treatment may be carried out under dry conditions or with steam, e.g., at a temperature of from about 80° C. to 160° C.

After this treatment, the dyed textile generally will be subjected to one or more washes with water, preferably until all excess dyestuff is completely removed. If desired, this step may be followed by a fastening treatment carried out, e.g., with dicyanodiamide derivatives, or with cationic based products of known type.

The process of the present invention provides several advantages as compared to known dyeing processes. Water consumption is considerably reduced, with consequent cost reductions and environmental advantages. The process of the invention is very simple and inexpensive because it requires a short operating time and relatively small amounts of dyestuff. Moreover, the porous granules may be recovered and re-used with no loss of dyestuff.

The process of the present invention also makes it possible to obtain textiles dyed in a non-uniform fashion having irregular, random, maculated patterns on their surfaces. These irregular patterns may be of the same color or of different colors. The shape and size of such patterns are a function of many variables including the particular impregnated granules used and the residence time inside the dyeing chamber.

Additionally, the process of the present invention makes it possible to obtain textiles dyed in a non-uniform fashion with different colors extending and fading into one another at their borders due to the mutual penetration and overlapping of the colors. Thus, multi-colored textile products with variable hues or shades may be obtained.

The textiles obtained by the process of the present invention are significantly different from those obtained by the processes known in the prior art which, as is well-known, generally have more or less regular, perfectly distinguished and defined color patterns.

In order to further illustrate the present invention, the following examples are given. These examples are for purposes of illustration and not limitation.

EXAMPLE 1

An aqueous solution of C.I. Direct Blue 71 No. 34140 dye was prepared, which had a dye concentration of 10 g/liter. The solution was sprayed on 40 kg of pumice stones, having dimensions of from 1 to 5 cm, until the pumice stones were saturated. The impregnated pumice was charged to a drum of a washing machine together with 12 kg of trousers of white cotton cloth. The drum dimensions were 150 cm in diameter, and 150 cm in depth. The drum was revolved for nine minutes at a speed of 27–28 rpm with the revolution direction being reversed every 30 seconds.

After this treatment, the pumice stones were separated from the resulting randomly dyed trousers. The trousers then underwent a thermal treatment with steam at 115° C., and were washed. The external surfaces of each pair of trousers were blue-dyed in a non-uniform fashion, and had white areas which were not touched by the impregnated pumice stones, particularly in the recessed areas along the seams.

FIG. 1 is a photograph showing a portion of a pair of cloth trousers randomly dyed by the process of this example. This photograph shows the random blue-dyed effect and the white or undyed areas, particularly along the recessed area near the overlapped parts, i.e., seam, of the trousers.

EXAMPLE 2

Example 1 was repeated, however using C.I. Direct Red 26 No. 29190 dye as the dyestuff.

Figure 2:
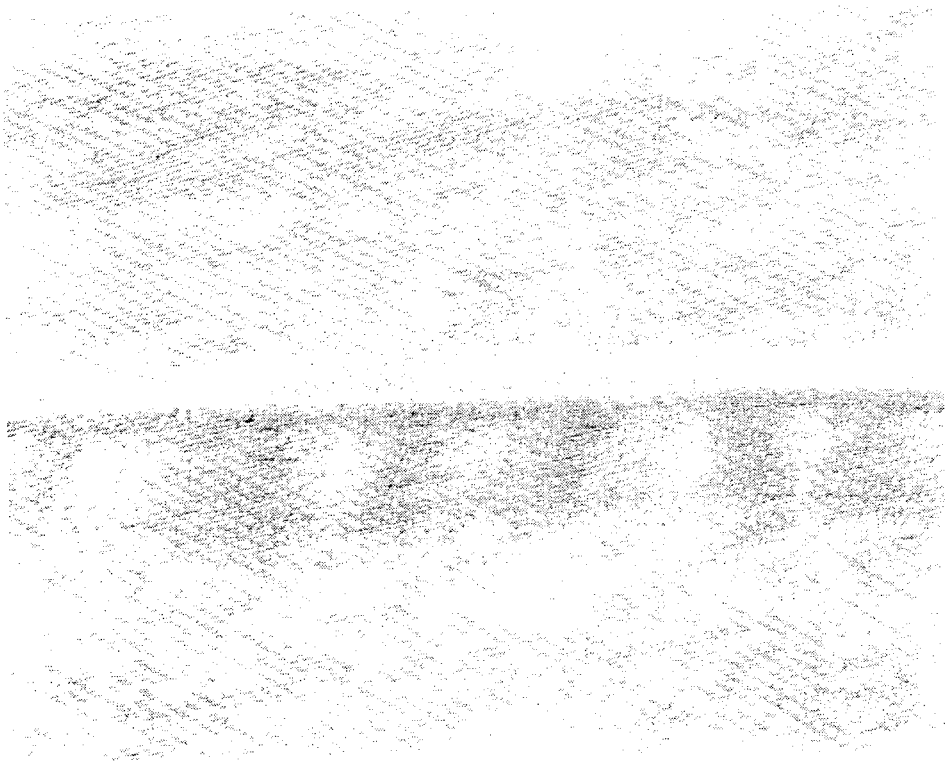

FIG. 2 is a photograph showing a portion of a pair of cloth trousers randomly dyed according to this example. The photograph shows the random red-dyed effect and the white or undyed areas, particularly along the recessed area near the overlapped parts, i.e., seam, of the trousers.

EXAMPLE 3

An aqueous solution was prepared by dissolving 20 g of C.I. reactive Black 85 dye in 1 liter of solution containing 2 g/l NaOH and 10 g/l $Na_2CO_3$. The dyestuff solution was sprayed on pumice stones under the same conditions as in Example 1.

120 kg of the impregnated pumice stones were charged to the drum of a washing machine equal in size to that of Example 1 together with 12 kg of cotton cloth trousers of light blue color. The treatment time was 5 minutes with a revolution speed of the drum of 27–28 rpm, with the direction of revolution being reversed every 30 seconds. After the separation of the pumice stones, the resulting randomly dyed trousers were treated with steam at 115° C., washed, and then treated with a solution containing 1 g/liter of a dicyanodiamide and formaldehyde derivative fixing agent marketed by ROL under the trademark FISSATORE D®.

The trousers were dyed in a discontinuous fashion and exhibited a "marble" look with random maculated patterns of black color on a light blue background. A higher discontinuity in color was observed along the seams.

EXAMPLE 4

Three aqueous solutions were prepared having the following compositions:

Solution A: 5 g/l of C.I. Direct Blue 71 No. 34140 dye;

Solution B: 5 g/l of C.I. Direct Red 26 No. 29190 dye; and

Solution C: 5 g/l of C.I. Direct Yellow 28 No. 19555 dye.

12 kg of white cotton cloth trousers were processed as follows:

A. Solution A was sprayed on 40 kg of pumice stones having dimensions of from 1 to 5 cm until the pumice stones were saturated. The impregnated pumice stones were charged to a drum of a washing machine together with the trousers. The drum dimensions were 150 cm in diameter, and 150 cm in depth. The drum of a washing machine together with the trousers. The drum was revolved for seven minutes at a speed of 27–28 rpm with the revolution direction being reversed every 30 seconds. Thereafter, the pumice stones were separated from the resulting randomly blue-dyed trousers, and the washing machine was washed.

B. The randomly blue-dyed trousers were then charged to the same washing machine drum with 40 Kg of pumice stones having dimensions of from 1 to 5 cm and having been impregnated until saturation with Solution B. The treatment conditions and the revolution of the drum were the same as in the first treatment (A). Thereafter, the pumice stones were separated from the resulting randomly blue and red dyed trousers, and the washing machine was again washed.

C. The randomly blue and red dyed trousers were then charged to the same washing machine drum with 40 Kg of other pumice stones having dimensions of from 1 to 5 cm and having been impregnated until saturation with Solution C. The treatment conditions and the revolution of the drum were the same as in the first two treatments (A and B).

After separation from the pumice stones, the randomly blue-red-yellow dyed trousers were subjected to a thermal treatment with steam at 115° C. for 20 minutes, washed and then immersed and agitated for 15–20 minutes at 40° C. in a solution containing 2 g/l of a dicyanodiamide and formaldehyde derivative fixing agent marketed by ROL under the trademark FISSATORE D®.

Each pair of trousers was blue-red-yellow dyed in a random and non-uniform fashion and had light or undyed areas which were not touched by the impregnated pumice stones. The undyed areas were particularly evident and larger in the recessed areas along the seams.

Figure 3:
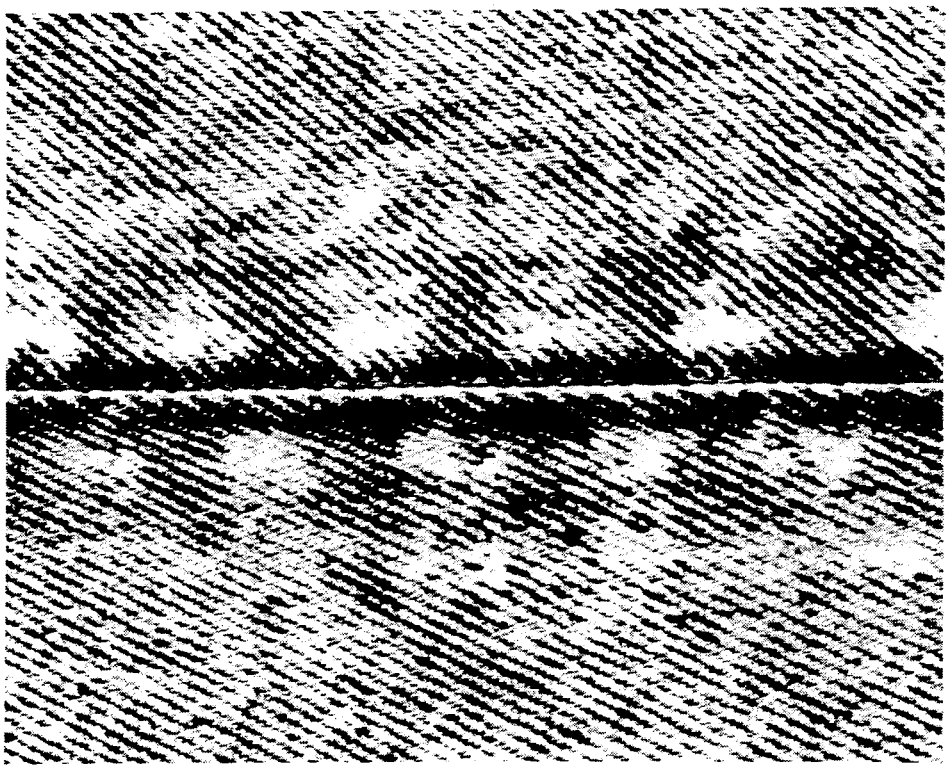

FIG. 3 is a photograph of a portion of a pair of trousers obtained by this example and shows the random combinations and mixtures of colors, and the light or undyed areas which are particularly prominent along the seams. The light areas form a continuous strip along the recessed areas near the seam of the trousers, such that the raised parts of the fabric are randomly dyed while the lower parts remain light or undyed.

While the invention has been described above with respect to preferred embodiments, it will be understood that other forms and embodiments may be made without departing from the spirit and scope of the invention.

What is claimed is:

1. A method of producing a non-uniformly dyed textile which is in a wet or dry condition comprising the steps of:

(a) impregnating granules of a rigid, coarse, permeably material with a dye;

(b) placing the impregnated granules and the textile together in a rotatable chamber;

(c) dyeing said textile in a dry state by dry-tumbling the textile and the granules together for a period of time sufficient to produce a random dyed effect on the textile; and (d) recovering the granules following their separation from the randomly-dyed textile.

2. The method of claim 1, wherein some of said granules are impregnated with a given dye and other of said granules are impregnated with one or more different dyes.

3. The method of claim 1, further comprising (e) thermally treating the randomly dyed textile to fix the dye to the textile product; and (f) removing any excess dye from the dyed textile by aqueous washing.

4. The method of claim 3, wherein the dyed textile, after washing, is submitted to a fastening treatment to chemically fasten the deposited dye.

5. The method of claim 1, wherein the granules are impregnated with a solution or dispersion containing a mixture of dyes.

6. The method of claim 1, wherein the granules are of pumice.

7. The method of claim 1, wherein the dye is selected from the group consisting of reactive dyes, sulphur dyes, vat dyes, acid dyes, basic dyes, cationic dyes, direct dyes, mordant dyes, and pigments.

8. The method of claim 1, wherein the chamber is revolved at a speed of from about 1 to 50 rpm.

9. The method of claim 8, wherein the revolving time is from about 1 to 60 minutes.

10. The method of claim 1, wherein the weight ratio of the granules to the textile to be dyed is from about 1:1 to 100:1.

11. The method of claim 10, wherein said weight ratio is from about 2:1 to 50:1.

12. The method of claim 3, wherein the thermal treatment is carried out under dry conditions.

13. The method of claim 3, wherein the thermal treatment is carried out with steam at a temperature of from about 80° C. to 160° C.

14. A method of producing a non-uniformly dyed multicolored textile which is in a wet or dry condition comprising the steps of:

(a) impregnating granules of a rigid, coarse, permeably material with a first dye;

(b) placing the impregnated granules and the textile together in a rotatable chamber;

(c) dyeing said textile in a dry state by dry-tumbling the textile and the granules together for a period of time sufficient to produce a random dyed effect on the textile;

(d) recovering the granules following their separation from the randomly-dyed textile; and (e) repeating steps (a) through (d) with granules that have been impregnated with a second, different dye.

15. The method of claim 14, further comprising:

(f) thermally treating the randomly dyed textile to fix the dye to the textile product; and (g) removing any excess dye from the randomly dyed textile by aqueous washing.

16. The method of claim 15, wherein the dyed textile is submitted to a fastening treatment to chemically fasten the deposited dye.

17. A textile dyed non-uniformly by the method of claim 1.

18. A textile dyed non-uniformly with different colors by the method of claim 2.

19. A textile dyed non-uniformly with different colors by the method of claim 14.

* * * * *

UNITED STATES PATENT AND TRADEMARK OFFICE

CERTIFICATE OF CORRECTION

PATENT NO. : 5,064,443

DATED : November 12, 1991

INVENTOR(S) : FRANCESCO RICCI

It is certified that error appears in the above-identified patent and that said Letters Patent is hereby corrected as shown below:

Column 2, line 25: Insert the following paragraph: --The file of this patent contains at least one drawing executed in color. Copies of this patent with color drawing(s) will be provided by the Patent and Trademark Office upon request and payment of the necessary fees.--

Column 6, line 2-3: Delete "The drum of a washing machine together with the trousers."

Signed and Sealed this

Second Day of March, 1993

*Attest:*

STEPHEN G. KUNIN

*Attesting Officer*

*Acting Commissioner of Patents and Trademarks*